US009364847B2

(12) United States Patent
Moribe et al.

(10) Patent No.: US 9,364,847 B2
(45) Date of Patent: Jun. 14, 2016

(54) LIQUID COATING DEVICE, LIQUID COATING DEVICE CONTROL METHOD, AND IMAGE FORMING SYSTEM INCLUDING LIQUID COATING DEVICE

(71) Applicants: Junichi Moribe, Ibaraki (JP); Kohji Kuwana, Ibaraki (JP)

(72) Inventors: Junichi Moribe, Ibaraki (JP); Kohji Kuwana, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 12 days.

(21) Appl. No.: 14/726,681

(22) Filed: Jun. 1, 2015

(65) Prior Publication Data

US 2015/0360254 A1 Dec. 17, 2015

(30) Foreign Application Priority Data

Jun. 11, 2014 (JP) ..... 2014-120742

(51) Int. Cl.

| | |
|---|---|
| ***B41J 2/015*** | (2006.01) |
| ***B05C 1/08*** | (2006.01) |
| ***B05C 11/10*** | (2006.01) |
| ***B05D 1/28*** | (2006.01) |
| ***B41J 11/00*** | (2006.01) |
| ***B41M 5/00*** | (2006.01) |
| ***B41J 2/21*** | (2006.01) |

(52) U.S. Cl.

CPC . *B05C 1/08* (2013.01); *B05C 11/10* (2013.01); *B05D 1/28* (2013.01); *B41J 2/2114* (2013.01); *B41J 11/0015* (2013.01); *B41M 5/0011* (2013.01)

(58) Field of Classification Search

CPC ..... B05C 11/10; B05C 1/08; B41J 11/0015; B41J 2/2114; B41M 5/0011; B41M 5/0017

USPC ..... 347/101, 21, 19, 93

See application file for complete search history.

(56) References Cited

U.S. PATENT DOCUMENTS

2013/0106946 A1* 5/2013 Sunaoshi ..... 347/21

FOREIGN PATENT DOCUMENTS

| | | |
|---|---|---|
| JP | 2013-073440 | 4/2013 |
| JP | 2014-019028 | 2/2014 |

* cited by examiner

*Primary Examiner* — Henok Legesse

(74) *Attorney, Agent, or Firm* — Oblon, McClelland, Maier & Neustadt, L.L.P.

(57) ABSTRACT

A liquid coating device includes a container to store a liquid; a liquid reservoir having a greater air-tightness than that of the container; a liquid coating applicator to apply a liquid stored in the container to a target object; a liquid conveyer to convey the liquid stored in the container to the liquid reservoir; and a controller to control operation of the liquid coating device. When the liquid coating applicator is disabled, the controller conveys the liquid stored in the container to the liquid reservoir.

5 Claims, 6 Drawing Sheets

LIQUID COATING DEVICE, LIQUID COATING DEVICE CONTROL METHOD, AND IMAGE FORMING SYSTEM INCLUDING LIQUID COATING DEVICE

CROSS-REFERENCE TO RELATED APPLICATION

The present application claims priority pursuant to 35 U.S.C. §119(a) from Japanese patent application number 2014-120742, filed on Jun. 11, 2014, the entire disclosure of which is incorporated by reference herein.

BACKGROUND

1. Technical Field

Exemplary embodiments of the present invention relate to a liquid coating device, a liquid coating device control method, and an image forming system including the liquid coating device, and in particular, to a method of preventing deterioration of a coating liquid.

2. Related Art

With advancing digitization of information, electronic information needs to be output via a printer or a facsimile machine, making image processing devices such as scanners indispensable. Such image processing devices include, for example, imaging, image forming, and communication functions, and therefore can be used as a printer, a facsimile machine, and a copier.

Among these image processing devices, the image forming apparatus used for outputting electronic documents should avoid adversely affecting image quality, such as bleeding, density fluctuation, color tone fluctuation, and bleed-through. For improved image quality, a technology to coat print media with a treatment liquid to concentrate color material of the ink is known. In such a technology, a squeeze roller is disposed in a container and rotates while being soaked in the treatment liquid, so that the treatment liquid is applied to the coating roller and a target object such as a paper roll is coated.

In addition, to ease maintenance when using only some of the functions that the image processing apparatus employs, when a command to disable either printing or reading is received from an external device, the process moves to a function disabling mode to disable the subject function. In this function disabling mode, even if an error is detected related to the disabled function, and the image processing apparatus does not report the error to the external device.

In a liquid coating applicator to apply the treatment liquid in the image forming apparatus, the treatment liquid is contained in a container so that applying the treatment liquid is smoothly performed. As a result, in the image forming process, even though the liquid coating applicator is disabled, because the container is filled with the treatment liquid, the treatment liquid remaining in the container without being consumed is exposed to air and deteriorates.

Such a problem is not limited to the treatment liquid in the image forming apparatus, but may occur as long as the apparatus includes a liquid coating applicator to apply a liquid that may deteriorate upon contact with air.

SUMMARY

In one embodiment of the disclosure, there is provided an optimal liquid coating device including a container to store a liquid; a liquid reservoir having a greater air-tightness than that of the container; a liquid coating applicator to apply the liquid stored in the container to a target object; a liquid conveyer to convey the liquid stored in the container to the liquid reservoir; and a controller to control operation of the liquid coating device. When the liquid coating applicator is disabled, the controller conveys the liquid stored in the container to the liquid reservoir.

In one embodiment of the disclosure, there is provided an optimal image forming system including an image forming device to form an image by discharging color material to a target object; and a liquid coating device to apply a liquid to the target object before outputting the formed image. The liquid coating device includes a container to store the liquid; a liquid reservoir; a liquid coating applicator to apply the liquid stored in the container to the target object; a liquid conveyer to convey the liquid stored in the container to the liquid reservoir having a higher air-tightness than that of the container; and a controller to control operation of the liquid coating device. When the liquid coating applicator is disabled, the controller conveys the liquid stored in the container to the liquid reservoir.

In one embodiment of the disclosure, there is provided an optimal method of controlling a liquid coating device including applying a liquid stored in a container to a target object, by a liquid coating applicator; conveying the liquid stored in the container to a liquid reservoir having a higher air-tightness than that of the container, by a liquid conveyer; and conveying the liquid stored in the container to the liquid reservoir when the liquid coating applicator is disabled.

These and other objects, features, and advantages of the present invention will become apparent upon consideration of the following description of the preferred embodiments of the present invention when taken in conjunction with the accompanying drawings.

DETAILED DESCRIPTION

Referring now to drawings, preferred embodiments of the present invention will be described in detail. In the present embodiment, an image forming system including an inkjet-type image forming apparatus employing a paper roll or a rolled sheet includes a liquid coating device to coat a liquid onto a sheet surface before outputting image by the image forming apparatus.

Figure 1:
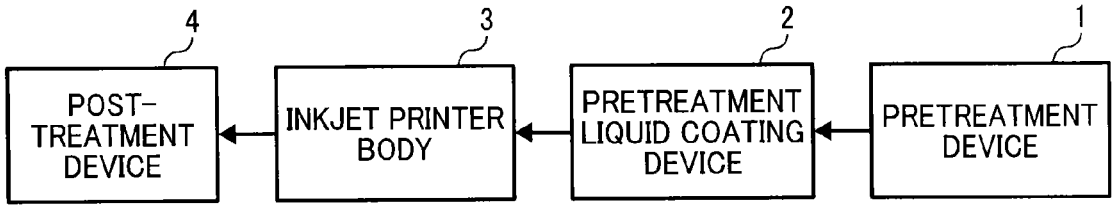
FIG. 1 illustrates an exemplary configuration of an image forming system including a pretreatment liquid coating device according to an embodiment of the present invention.

FIG. 1 is a view illustrating an overall structure of an image forming system according to the present embodiment. As illustrated in FIG. 1, the image forming system according to the present embodiment includes a pretreatment device 1, a pretreatment liquid coating device 2, an inkjet printer 3, and a post-treatment device 4. The pretreatment device 1 sends a roll of paper S, the pretreatment liquid coating device 2 coats a liquid on a surface of the roll of paper S sent from the pretreatment device 1, the inkjet printer 3 discharges color material to the paper roll S on which the liquid is coated by the pretreatment liquid coating device 2, thereby forming an image thereon, and the post-treatment device 4 winds up the sheet on which the image is formed. Specifically, in the present embodiment, the pretreatment liquid coating device 2 serves as a liquid coating device.

In the structure illustrated in FIG. 1, the pretreatment liquid coating device 2 includes a liquid coating section to apply a liquid to the roll, and operation of the liquid coating section is disabled. Even in such a case, the pretreatment liquid coating device 2 is appropriately controlled. Specifically, the pretreatment liquid coating device 2 coats a treatment liquid to improve a quality of the surface of the roll of paper S. When the treatment liquid is coated on the whole surface of the roll of paper S, moisture content of the ink discharged onto the surface of the paper roll S by the inkjet printer 3 swiftly permeates the paper roll S and color component is thickened and further, drying is accelerated.

With this, ink bleed discharged on the paper roll S, density fluctuation, color tone fluctuation, and bleed-through are prevented, thereby improving printing quality and shortening the time required for drying, so that printing productively is improved. That is, the treatment liquid functions as a fixing agent. In the present embodiment, the pretreatment liquid coating device 2 coats a treatment liquid on the paper roll. However, the coating target is not limited to paper but may be film, plastic sheet, etc.

Figure 2:
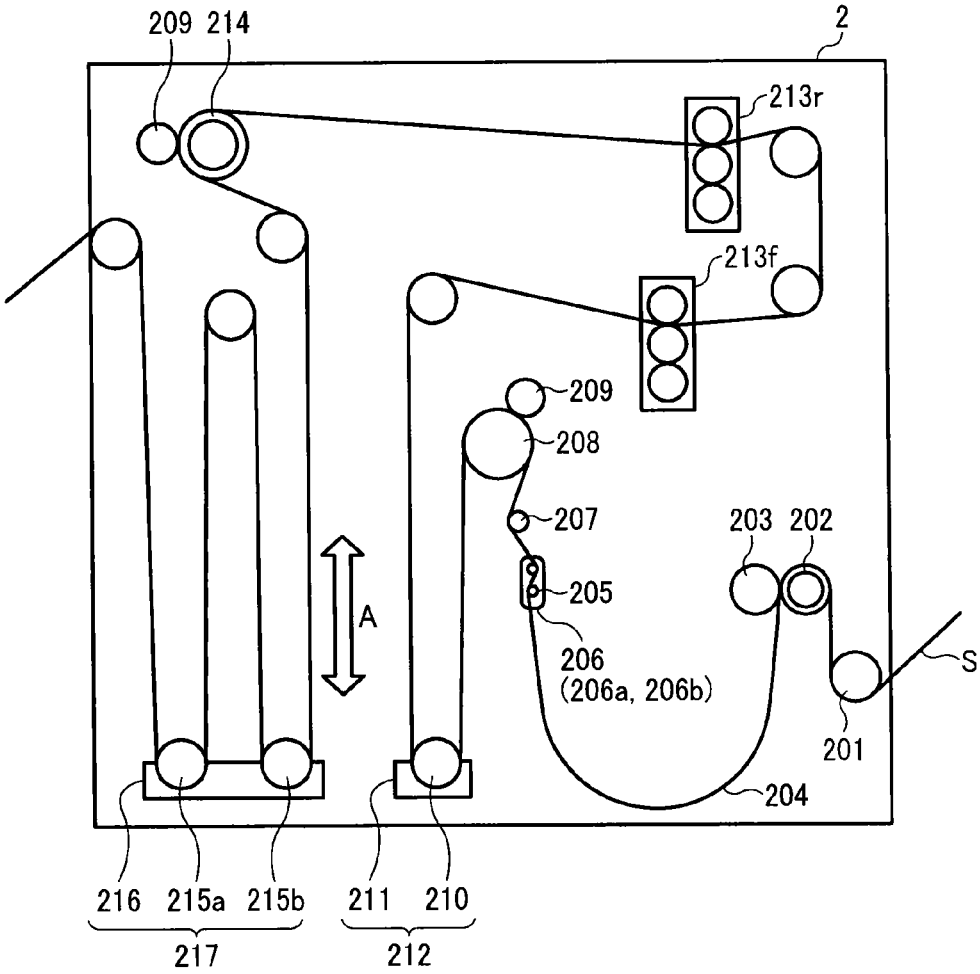
FIG. 2 illustrates an exemplary configuration of the pretreatment liquid coating device according to the embodiment of the present invention.

FIG. 2 illustrates a schematic configuration of the pretreatment liquid coating device 2 from a view of the conveyance path of the paper roll. As illustrated in FIG. 2, a plurality of guide rollers 201 each with a shaft bearing at an edge are disposed inside the pretreatment liquid coating device 2. The guide rollers form a conveyance path of the paper roll S.

A feed-in roller 202 is a roller driven to rotate by a drive source such as a motor. The feed-in roller 202 is pressed by a feed-in nip roller 203 with pressure via an elastic force of the elastic member such as a spring. When the feed-in roller 202 is driven to rotate, the paper roll S nipped by the feed-in nip roller 203 and the feed-in roller 202 is pulled in from the pretreatment device 1 disposed upstream of the pretreatment liquid coating device 2. The paper roll S fed and conveyed downstream by the feed-in roller 202 and the feed-in nip roller 203 is tension-released and is bending, so that an air loop 204 is formed.

The paper roll S that has passed through the air loop 204 passes between a pass shaft 205 and an edge guide 206. As illustrated in FIG. 2, the pass shaft 205 includes two shafts parallel to each other in a direction perpendicular to a conveyance direction of the paper roll S, that is, in the main scanning direction. The paper roll S passes between two shafts of the pass shaft 205 in an S-shape.

A pair of edge guides 206 is supported by the pass shaft 205 and includes two guide plates 206*a*, 206*b*, that are so disposed as to have each surface thereof substantially parallel to each other, and a distance between the guide plates 206*a*, 206*b* is substantially the same as the width of the paper roll S in the main scanning direction. As a result, travelling position of the paper roll S in the main scanning direction corresponds to a position of the edge guide 206, so that a stable conveyance is possible.

A fixedly mounted tension shaft 207 maintains tension on the paper roll S that has passed through a position between the pass shaft 205 and the edge guide 206 sufficient to secure stability in the conveyance. The paper roll S that has passed through the tension shaft 207 further passes through a position between an in-feed roller 208 and a feed nip roller 209.

A plurality of feed nip rollers 209 is provided along a shaft direction of the in-feed roller 208 and presses against the in-feed roller 208 via an elastic force such as a spring.

The paper roll S that has passed through a portion between the in-feed roller 208 and the feed nip roller 209 is wound around a rotatable dancer roller 210 from a bottom side thereof. The dancer roller 210 is rotatably disposed on a movable frame 211 via a shaft bearing disposed at an end of the roller. The dancer roller 210 and the frame 211 form a dancer roller unit 212.

Specifically, the dancer roller unit 212 is hung from the paper roll S. The dancer roller unit 212 is movable along a vertical direction as indicated by an arrow A in FIG. 2. In addition, a dancer roller sensor is disposed in a range where the dancer roller unit 212 moves. The drive source of the in-feed roller 208 is controlled to move the roller faster or slower based on a detection signal from the dancer roller sensor, so that a position of the dancer roller unit 212 is adjusted.

The paper roll S that has passed through the dancer roller 210, further passes through a front surface coating applicator 213*f*, where a treatment liquid is coated on a front surface of the paper roll S, and further passes through a rear surface coating applicator 213*r*, where a treatment liquid is applied on a rear surface of the paper roll S reversed by a guide roller 201, so that both surfaces of the paper roll S are coated with a treatment liquid. Details of the coating applicators will be described later below.

The paper roll S that has passed through the coating applicators, further passes through a position between an out-feed roller 214 and another feed nip roller 209. A plurality of feed nip rollers 209 is disposed along a shaft direction of the out-feed roller 214, and is pressed against the out-feed roller 214 via an elastic force of a spring, for example. When the out-feed roller 214 is driven to rotate by the drive source such as a motor, the paper roll S is conveyed while being nipped between the out-feed roller 214 and the feed nip roller 209.

Rotatable dancer rollers 215*a*, 215*b* are disposed downstream of the out-feed roller 214 and the feed nip roller 209, and the guide rollers 201 are alternately disposed together with two dancer rollers, so that a W-shaped conveyance path of the paper roll S is constructed as illustrated in FIG. 2.

The dancer rollers 215*a*, 215*b* are rotatably disposed on a movable frame 216 via a shaft bearing disposed at lateral ends of the roller. The dancer rollers 215*a*, 215*b* and the movable frame 216 form a dancer roller unit 217. Specifically, the dancer roller unit 217 is hung from the paper roll S. The dancer roller unit 217 is movable along a vertical direction as indicated by an arrow A in FIG. 2.

In addition, another dancer roller sensor is disposed in a range where the dancer roller unit 217 moves. The drive source of the out-feed roller 214 is controlled to move the roller faster or slower based on a detection signal from the dancer roller sensor, so that a position of the dancer roller unit 217 is adjusted.

After having passed through an inside of the pretreatment liquid coating device 2, the paper roll S is fed into the inkjet printer 3 disposed downstream of the pretreatment liquid coating device 2.

Next, a schematic configuration of the pretreatment liquid coating device 2 will be described from a view of the supply path of the treatment liquid to the front surface coating applicator 213*f* and the rear surface coating applicator 213*r*.

Figure 3:
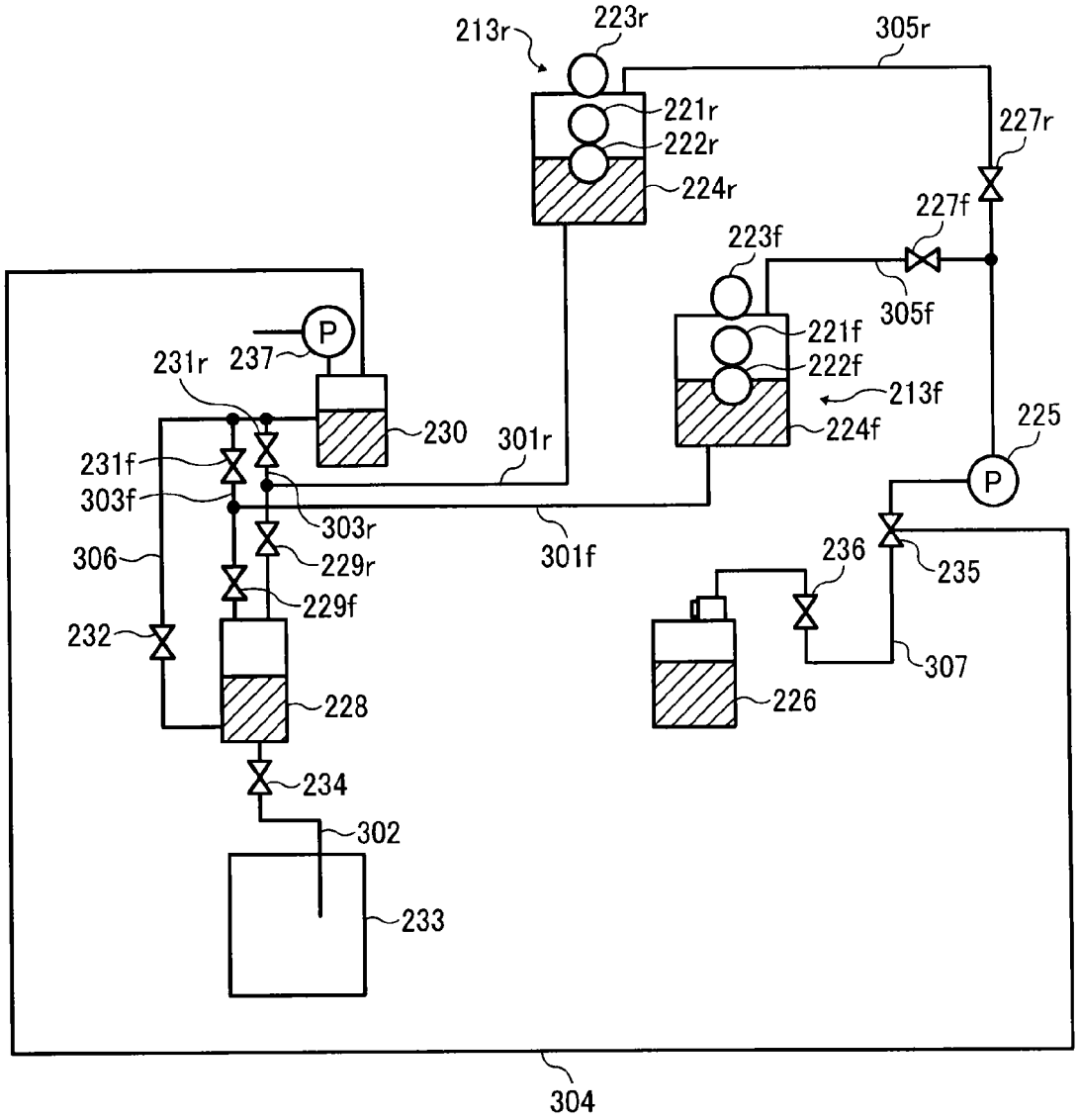
FIG. 3 illustrates an exemplary configuration of the pretreatment liquid coating device according to the embodiment of the present invention.

FIG. 3 illustrates a schematic configuration of the pretreatment liquid coating device 2 from a view of the supply path of the treatment liquid to the front surface coating applicator 213*f* and the rear surface coating applicator 213*r*.

As illustrated in FIG. 3, the front surface coating applicator 213*f* includes a cylinder-shaped coating roller 221*f* to coat the treatment liquid, a squeeze roller 222*f* to thin the treatment liquid and transfer the thus-thinned film to the coating roller 221*f*, and a pressure roller 223*f* to sandwich the paper roll S together with the coating roller 221*f*. In addition, the squeeze roller 222*f* is soaked in the treatment liquid inside a supply pan 224*f* in which the treatment liquid is reserved, controls a height of the liquid level based on the result obtained by a liquid level sensor that detects a liquid amount inside the supply pan 224*f*, to thus adjust a coating amount to be constant.

The rear surface coating applicator 213*r* is configured similarly to the front surface coating applicator 213*f* illustrated in FIG. 3. Hereinafter, the coating rollers 221*f*, 221*r* may be inclusively called the coating roller 221, the squeeze rollers 222*f*, 222*r* may be inclusively called the squeeze roller 222, the pressure rollers 223*f*, 223*r* may be inclusively called the pressure roller 223, and the supply pans 224*f*, 224*r* may be inclusively described as the supply pan 224.

The supply pan 224 is configured to cover the coating roller 221, so that evaporation of the treatment liquid inside the supply pan 224 is restricted. However, a pressed portion between the coating roller 221 and the pressure roller 223 needs to be kept open, so that the supply pan 224 is not completely closed.

Thus, as illustrated in FIG. 3, a reserve tank 228 with a higher air-tightness than that of the supply pan 224 is disposed as a liquid reservoir. An electromagnetic valve 229 disposed at an evacuation path 301*f* (301*r*) to communicate the reserve tank 228 with the supply pan 224 is open, the treatment liquid in the supply pan 224 is conveyed, due to water head difference, to the reserve tank 228 via the evacuation path 301*f* (301*r*). Specifically, the electromagnetic valve 229 and the evacuation path 301*f* (301*r*) function each as a liquid conveyor.

The electromagnetic valve 229 is open when the pretreatment liquid coating device 2 is not powered on, when the printing process is suspended for more than the one hour required for replacement of the paper roll S, change of the printing pattern, and the like. With this structure, even when the printing process is suspended, filling the treatment liquid into the supply pan 224 won't take much waiting time.

In addition, viscosity of the treatment liquid in the reserve tank 228 increases when the treatment liquid is not used for a long time period (for example, more than several weeks). When the treatment liquid in the reserve tank 228 is not used for more than a predetermined time period, an electromagnetic valve 234 disposed on a path 302 that communicates the reserve tank 228 with a waste liquid tank 233 is released to open. With this structure, the treatment liquid inside the reserve tank 228 is collected into the waste liquid tank 233, so that the treatment liquid is kept fresh.

In addition, a circulation path 303*f* (303*r*) from the evacuation path 301*f* (301*r*) communicating with a filter 230 is branched. In the circulation path 303*f* (303*r*), an electromagnetic valve 231*f* (231*r*) is disposed upstream of the filter 230 and a tridirectional valve 235 is disposed downstream of the filter 230. The filter 230 removes paper dust accumulating inside the supply pan 224 and prevents the treatment liquid from becoming a paste-like solution. The paper dust accumulating inside the supply pan 224 is produced due to slidable movement of the paper roll S sliding on the coating roller 221 and the pressure roller 223.

When the electromagnetic valve 231*f* (231*r*) is opened while the treatment liquid is being coated, part of the treatment liquid inside the supply pan 224 passes through the filter 230 via the evacuation path 301*f* (301*r*) and the circulation path 303*f* (303*r*), so that the paper dust and the like included in the treatment liquid is removed. As a result, the tridirectional valve 235 is brought to a state in which the filter 230 and a supply pump 225 communicate, and an electromagnetic valve 227 disposed on a supply path 305*f* (305*r*) that communicates the supply pump 225 with the supply pan 224 is released. With this structure, when a filter pump 237 and the supply pump 225 are driven, the treatment liquid from which paper dust is removed by the filter 230 is supplied to the supply pan 224 by the supply pump 225 via paths 304, 305*f* (305*r*).

The liquid level sensor that detects a liquid level inside the supply pan 224 detects that the liquid level inside the supply pan 224 is below a predetermined amount, that is, a low level, the treatment liquid is replenished from the reserve tank 228 or from a cartridge 226 to the supply pan 224.

When the treatment liquid is supplied from the reserve tank 228 to the supply pan 224, the electromagnetic valve 232 is open and the treatment liquid stored in the reserve tank 228 is fed from a circulation supply path 306 that communicates the reserve tank 228 with the filter 230 to the filter 230. As a result, the tridirectional valve 235 is brought to a state in which the filter 230 and the supply pump 225 are communicated, and the electromagnetic valve 227 disposed on the supply path 305*f* (305*r*) that communicates the supply pump 225 with the supply pan 224 is released. With this structure, when the supply pump 225 is driven, the treatment liquid that has passed through the filter 230 is supplied by the supply pump 225 via the paths 304, 305*f* (305*r*), and is supplied to the supply pan 224.

On the other hand, when the treatment liquid is supplied from the cartridge 226 to the supply pan 224, the electromagnetic valve 236 is released and the tridirectional valve 235 is brought to a state in which the cartridge 226 and the supply pump 225 are communicated and the electromagnetic valve 227 disposed on the supply path 305*f* (305*r*) that communicates the supply pump 225 with the supply pan 224 is released. With this structure, when the supply pump 225 is driven, the treatment liquid that is stored in a cartridge 226 is supplied by the supply pump 225 via the paths 307, 305*f* (305*r*), and is supplied to the supply pan 224 by the supply pump 225.

Whether the treatment liquid is supplied from the reserve tank 228 or the cartridge 226 to the supply pan 224 is determined based on a predetermined priority. For example, when the reserve tank 228 has a higher priority order, if the liquid level of the treatment liquid inside the reserve tank 228 is more than the predetermined level, the treatment liquid is supplied from the reserve tank 228 to the supply pan 224. When the liquid level of the treatment liquid inside the reserve tank 228 is below the predetermined level, the treatment liquid is switched to be supplied from the cartridge 226 to the supply pan 224.

When the liquid level sensor of the supply pan 224 detects that the liquid level inside the supply pan 224 is below a low level, the treatment liquid is started to be supplied, and when the liquid level sensor detects that the liquid level inside the supply pan 224 is more than a predetermined amount, that is, a high level, a supply of the treatment liquid to the supply pan 224 is stopped.

In the present embodiment, a case in which the liquid level sensor detects whether the liquid level inside the supply pan 224 is a low level or high level has been described. However, the above is one example, and the liquid level sensor may be configured to detect a liquid level to supply the treatment liquid to the supply pan 224, a liquid level to start coating operation of the treatment liquid, and a liquid level to stop supply of the treatment liquid to the supply pan 224, each as a different level.

Figure 4:
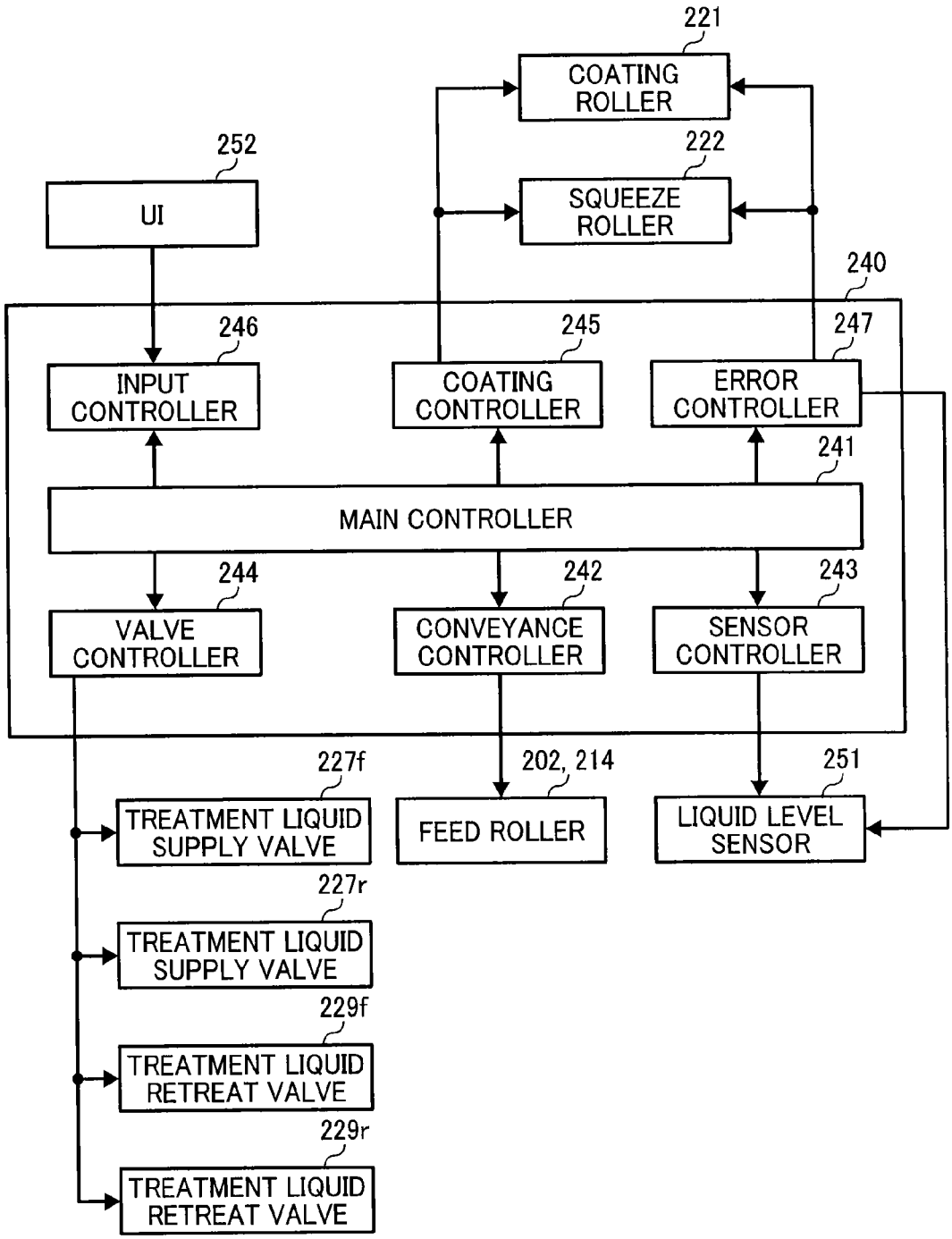
FIG. 4 illustrates a controller of the pretreatment liquid coating device according to the embodiment of the present invention.

FIG. 4 is a block diagram illustrating a controlling structure of the pretreatment liquid coating device 2 according to the present embodiment. As illustrated in FIG. 4, the pretreatment liquid coating device 2 according to the present embodiment includes a control unit 240 that controls various parts and components of the apparatus. The control unit 240 functions as a controller to control operation of the apparatus.

The control unit 240 is configured as a combination of software and hardware. Specifically, the control unit 240 is formed of a software controller including a central processing unit (CPU) computing in accordance with a control program such as firmware stored in a read only memory (ROM), non-volatile memory, non-volatile random access memory (NV-RAM), optical disk, and the like, and hardware such as ICs.

As illustrated in FIG. 4, the control unit 240 includes a main controller 241, a conveyance controller 242, a sensor controller 243, a valve controller 244, a coating controller 245, an input controller 246, and an error controller 247. The main controller 241 controls over each part included in the control unit 240 and issues commands to each part of the control unit 240. The conveyance controller 242 controls rotation of the feed-in roller 202 and the out-feed roller 214 in accordance with the control of the main controller 241, thereby conveying the paper roll.

The sensor controller 243 obtains a detection signal output from the liquid level sensor 251 and inputs the signal data to the main controller 241. The valve controller 244 controls opening and closing of the electromagnetic valves 227*f*, 227*r* (hereinafter, treatment liquid supply valves 227*f*, 227*r*) in accordance with the main controller 241, and controls supplying treatment liquid to the supply pan 224. The valve controller 244 controls opening and closing of the electromagnetic valves 229*f*, 229*r* (hereinafter, treatment liquid retreat valves 229*f*, 229*r*) in accordance with the main controller 241, and controls retreating the treatment liquid from the supply pan 224 to the reserve tank 228.

The coating controller 245 controls rotation of the squeeze roller 222 and the coating roller 221 in accordance with the main controller 241, and controls supplying the treatment liquid from the squeeze roller 222 to the coating roller 221 and coating the treatment liquid by the coating roller 221. The input controller 246 obtains input signals from a user interface (UI) 252 such as a touch panel or a keyboard, and inputs those signals to the main controller 241. The input signals include commands to disable or enable usage of the front surface coating applicator 213*f* and the rear surface coating applicator 213*r*.

The error controller 247 detects an error such as a failure that takes place in each section such as the coating roller 221, the squeeze roller 222, and the liquid level sensor 251 that construct the front surface coating applicator 213*f* and the rear surface coating applicator 213*r*, and inputs the error result to the main controller 241. In addition, the error controller 247 controls error detection and negates an error of a designated section in the pretreatment liquid coating device 2 in accordance with the control of the main controller 241, so that the error, if detected, is not input to the main controller 241.

In such a structure, one of the optimal controls performed in the present embodiment includes retreating control of the treatment liquid by the valve controller 244 when usage of the front surface coating applicator 213*f* and the rear surface coating applicator 213*r* is disabled. Hereinafter, among operation by the main controller 241, retreating control of the treatment liquid according to the present embodiment will be described.

Figure 5:
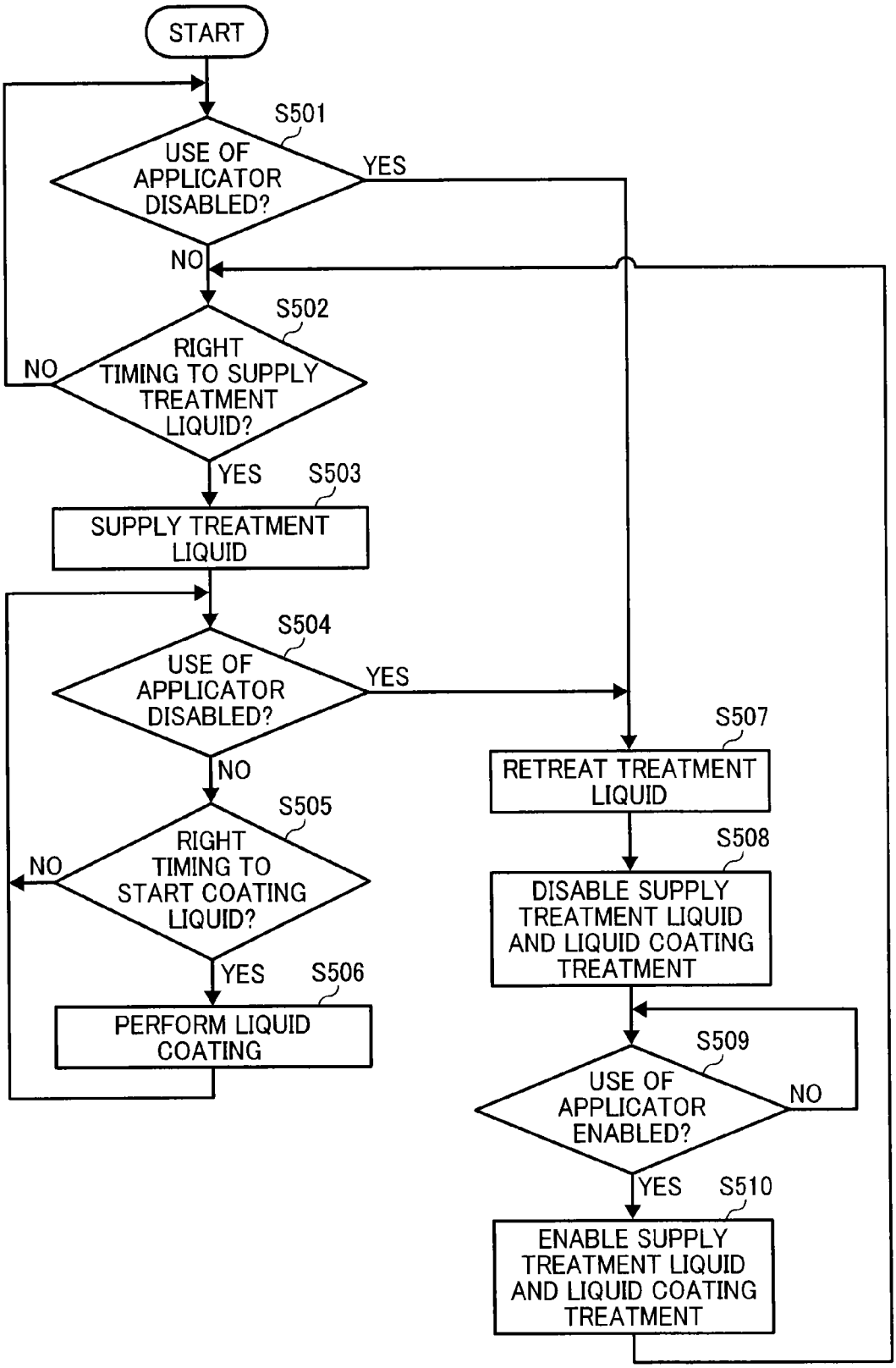
FIG. 5 illustrates a flowchart showing steps in a process of controlling operation of the pretreatment liquid coating device according to the embodiment of the present invention.

FIG. 5 is a flowchart illustrating operation of the main controller 241 according to the present embodiment. The flowchart illustrated in FIG. 5 shows operation to each of the front surface coating applicator 213*f* and the rear surface coating applicator 213*r*; however, operation related to the front surface coating applicator 213*f* will be described.

As illustrated in FIG. 5, the main controller 241 determines whether the front surface coating applicator 213*f* is disabled or not (in step S501). For example, the main controller 241 determines that the front surface coating applicator 213*f* is disabled upon receiving an input signal to show a command to disable the front surface coating applicator 213*f*.

When use of the front surface coating applicator 213*f* is enabled (NO in S501), the main controller 241 waits (No in S502) until timing to supply treatment liquid to the supply pan 224*f* (Yes in S502) is determined. For example, the main controller 241 determines that the treatment liquid should be supplied to the supply pan 224*f* when power to the pretreatment liquid coating device 2 is on, or when the liquid coating process of the front surface coating applicator 213*f* starts after the treatment liquid of the supply pan 224*f* is retreated in the reserve tank 228.

When the main controller 241 determines that the treatment liquid should be supplied to the supply pan 224*f* (Yes in S502), the main controller 241 causes the valve controller 244 to control the treatment liquid supply valve 227*f*, so that the treatment liquid is supplied from the reserve tank 228 or from the cartridge 226 to the supply pan 224*f* (S503). The valve controller 244 controls the tridirectional valve 235, the electromagnetic valve 232 (when supplying the treatment liquid from the reserve tank 228), and the electromagnetic valve 236 (when supplying the treatment liquid from the cartridge 226), in addition to the treatment liquid supply valve 227*f*.

The main controller 241 that has controlled supplying the treatment liquid to the supply pan 224*f*, determines whether the front surface coating applicator 213*f* is disabled or not (S504). When the front surface coating applicator 213*f* is enabled (NO in S504), the main controller 241 waits (No in S505) until timing to start coating the treatment liquid to the supply pan 224*f* (Yes in S505) is determined. For example, the main controller 241 determines that the coating of the treatment liquid should be started when a command to perform coating is received from an upper device of the pretreatment liquid coating device 2 such as an inkjet printer 3.

When the main controller 241 determines that the liquid coating process should be started (Yes in S505), the main controller 241 causes the coating controller 245 to start rotating the squeeze roller 222*f* so that the front surface coating applicator 213*f* starts to perform the liquid coating process (S506). Then, the main controller 241 returns to the step S501 to perform the subject process repeatedly.

On the other hand, when the front surface coating applicator 213*f* is disabled (Yes in S501 or Yes in S504), the main controller 241 causes the valve controller 244 to control the treatment liquid retreating valve 229*f*, so that the treatment liquid stored in the supply pan 224*f* is retreated to the reserve tank 228 (S507).

In addition, when the liquid level sensor 251 detects that the treatment liquid inside the supply pan 224*f* is below the low level, the main controller 241 controls such that the treatment liquid is not supplied from the reserve tank 228 or from the cartridge 226 to the supply pan 224*f* (S508). In addition, the main controller 241 controls the coating controller 245 not to perform the liquid coating process (S508). Steps S507 and S508 are not limited to this order, these may be performed in reverse order, and may be done in parallel.

After the treatment liquid is retreated in the reserve tank 228 and the supply of the treatment liquid is disabled, the main controller 241 maintains a state when the front surface coating applicator 213*f* is disabled (No in S509) until the front surface coating applicator 213*f* is enabled (Yes in S509). When the front surface coating applicator 213*f* is changed from the disabled setting to the enabled setting (Yes in S509), the main controller 241 enables the supply of the treatment liquid and the liquid coating process (S510), so that processes from S502 are repeated.

In the present embodiment, in step S510, the main controller 241 enables the supply of the treatment liquid and the liquid coating process, and the processes from S502 are repeated. However, after S510, the process may proceed to S501 and determination whether the use is disabled or not may be done again.

Figure 6:
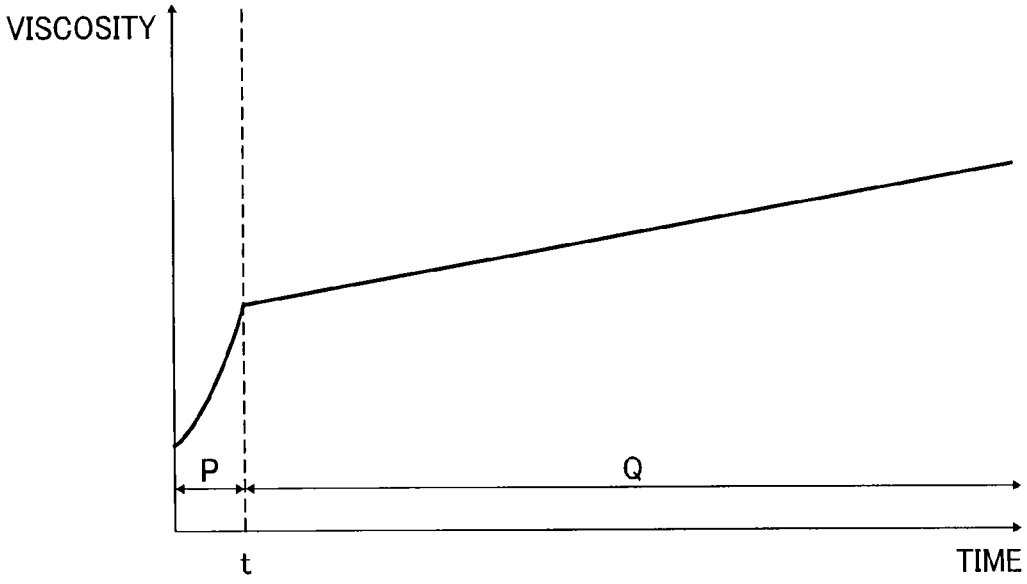
FIG. 6 is a graph to show a relation between the time of the treatment liquid left uncontrolled and a viscosity thereof according to the embodiment of the present invention.

FIG. 6 is a graph illustrating a relation between the time of the treatment liquid left uncontrolled and a viscosity thereof. As illustrated in FIG. 6, the horizontal x axis represents time lapsed and the y axis represents viscosity of the treatment liquid. In FIG. 6, the treatment liquid put in the supply pan 224 at time t is retreated to the reserve tank 228. Specifically, the treatment liquid is inside the supply pan 224 during a section P and inside the reserve tank 228 during a section Q.

As illustrated in FIG. 6, the treatment liquid put in the supply pan 224 has a lower air-tightness than in the reserve tank 228 and is exposed to air frequently, so that the higher viscosity in the section P than the section Q, that is, the degradation of the treatment liquid is acute. To prevent degradation of the treatment liquid, the treatment liquid stored in the supply pan 224 is preferably retreated to the reserve tank 228 immediately after the completion of the liquid coating process. However, if the treatment liquid retreated to the reserve tank 228 needs to be filled in the supply pan 224 when the next liquid coating process starts, a standby time occurs until completion of the filling in. Then, the treatment liquid remains in the supply pan 224 for a certain period of time (for example, a period P).

On the other hand, for example, when the front surface coating applicator 213*f* employing the supply pan 224*f* is disabled, there is no need of storing the treatment liquid in the supply pan 224*f* for the start of liquid coating process. Therefore, when the front surface coating applicator 213*f* is disabled, the treatment liquid stored in the supply pan 224*f* is preferably retreated in the reserve tank 228 swiftly. Due to this, the period during which the treatment liquid stays in the supply pan 224*f* is shortened, thereby preventing the deterioration of the treatment liquid.

Next, among operation of the main controller 241, operation of error detection control relative to the front surface coating applicator 213*f* and the rear surface coating applicator 213*r* serving as liquid coating applicators by the main controller 241 will be described.

Figure 7:
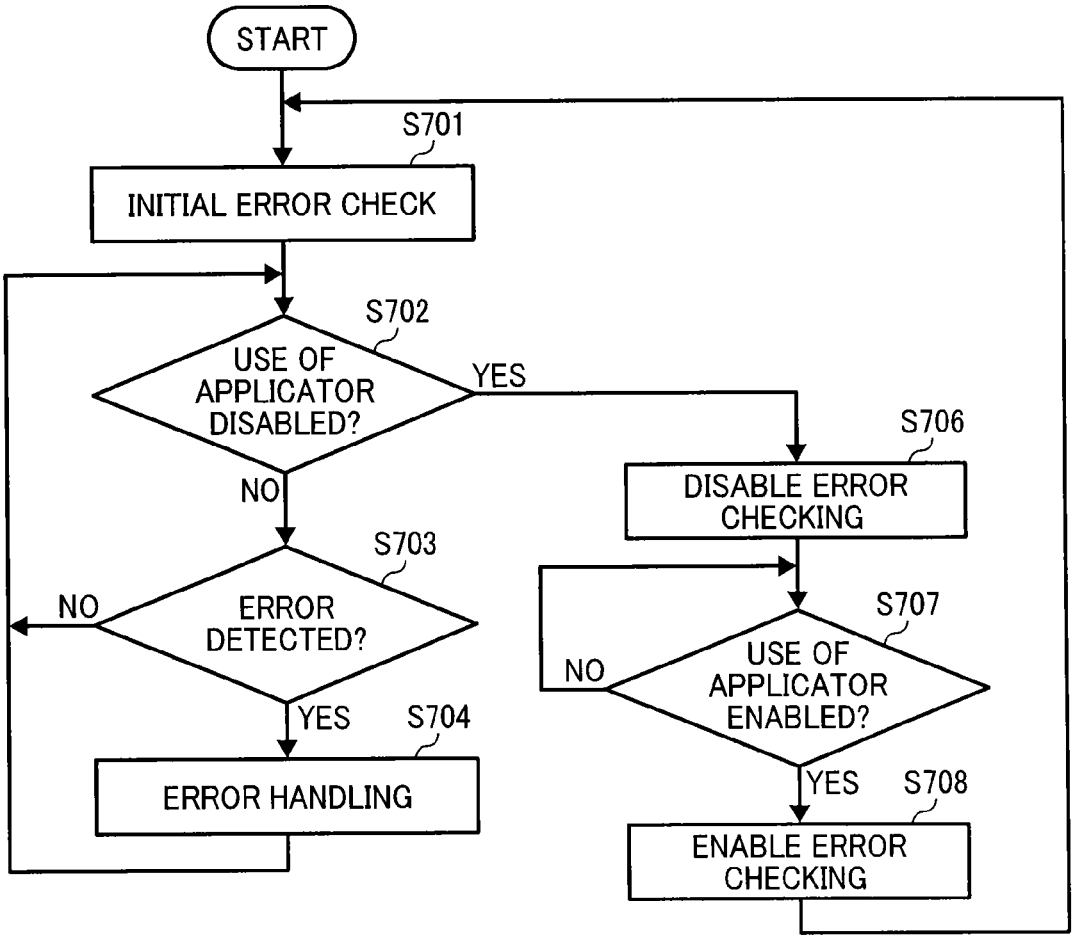
FIG. 7 illustrates an exemplary flowchart showing steps in a process of controlling operation of the pretreatment liquid coating device according to the embodiment of the present invention.

FIG. 7 is a flowchart illustrating operation of the main controller 241 according to the present embodiment. The flowchart showing steps in a process of FIG. 7 illustrates an operation to be performed to each of the front surface coating applicator 213*f* and the rear surface coating applicator 213*r*. Herein, exemplary operation performed to the front surface coating applicator 213*f* will be described.

As illustrated in FIG. 7, the main controller 241 causes the error controller 247 to perform checking operation of each component of the front surface coating applicator 213*f* such as the coating roller 221*f*, the squeeze roller 222*f*, and the liquid level sensor 251 as an initial error check (S701). Upon completion of the initial error check, the main controller 241 determines whether the front surface coating applicator 213*f* is disabled or not (S702). For example, the main controller 241 determines that the front surface coating applicator 213*f* is disabled upon receiving, from the input controller 246, an input signal to show a command to disable the front surface coating applicator 213*f*.

If the front surface coating applicator 213*f* is enabled (No in S702), the main controller 241 causes the error controller 247 to perform error checking of each component of the front surface coating applicator 213*f*. If an error such as failure occurrence is detected (Yes in S703), an error process is performed (S704). The error process includes, for example, a process in which an output controller has the UI 252 report that the error is detected, or alternatively, report the error to an upper device. On the other hand, when the error is not detected (No in S703), the main controller 241 returns to the step S702 to perform the subject process repeatedly.

On the other hand, if the front surface coating applicator 213*f* is disabled (Yes in S702), the main controller 241 causes the error controller 247 not to perform error checking of each component of the front surface coating applicator 213*f*. If the main controller 241 causes the error controller 247 not to perform error checking, the main controller 241 maintains a control state when the use is disabled (No in S707) until the front surface coating applicator 213*f* is enabled (Yes in S707). When the front surface coating applicator 213*f* is changed from the disabled setting to the enabled setting (Yes in S707), the main controller 241 enables the error checking (S708) so that processes from S701 are repeated.

In the above configuration, when the front surface coating applicator 213*f* is disabled, the main controller 241 causes the error controller 247 not to perform error checking of each component of the front surface coating applicator 213*f*. However, this kind of process is simply an example. The main controller 241 may control the error controller 247 not to input an error detection result to the main controller 241 even though an error has been detected, instead of the control not to perform error checking. In brief, any disabling control against the failure that has occurred to each component of the use-disabled front surface coating applicator 213*f* may only be possible.

As described above, in the image forming system including the pretreatment liquid coating device 2 according to the present embodiment, if the coating applicators 213*f*, 213*r* is disabled, the controller to control operation of the pretreatment liquid coating device 2 conveys the treatment liquid stored in the supply pan 224 to the reserve tank 228 that has more air-tightness than that of the supply pan 224. With this structure, deterioration of the treatment liquid stored in the supply pan 224 of the coating applicator of which use is disabled can be prevented.

In addition, the structure as described in the present embodiment is not limited to the treatment liquid in the image forming apparatus may be applied similarly to the system including a liquid coating device to apply a liquid that is apt to deteriorate up contact with air. Accordingly, the structure related to the present embodiment may prevent a liquid stored in a container from deteriorating even though the coating applicator is disabled.

In the image forming system including the pretreatment liquid coating device 2 according to the present embodiment, if the liquid coating device, that is, the coating applicators 213*f*, 213*r* is disabled, the controller to control operation of the pretreatment liquid coating device 2 disables a process related to the failure occurred to the liquid coating device of which usage is disabled. Conventionally, when the error was detected in any device by error checking, an entire operation of the pretreatment liquid coating device 2 stops. Accordingly, even though a failure occurs to the liquid coating applicator that is disabled, the pretreatment liquid coating device 2 itself was not useable and was therefore inconvenient.

With such a structure, when the liquid coating applicator is disabled, the error controller 247 does not perform error checking of the liquid coating applicator, neglects even an error that has been found, or disables the error checking, so that an event in which the whole apparatus cannot be used due to an error of the unused liquid coating applicator can be avoided.

In the above embodiment, a case in which the pretreatment liquid coating device 2 includes two liquid coating applicators, that is, the front surface coating applicator 213*f* and the rear surface coating applicator 213*r*, has been described. The above configuration is an example, and similar operation can be possible even in a case in which the pretreatment liquid coating device 2 includes one only liquid coating applicator. In this case, when the liquid coating applicator is disabled, the paper roll is conveyed to the inkjet printer 3 without the treatment liquid being applied thereto in the pretreatment liquid coating device 2.

In the above embodiment, a case in which the coating applicator 213 is disabled in response to the input signal from the UI 252 has been described. Alternatively, when the error controller 247 detects an error in the coating applicator 213, the malfunctioning coating applicator 213 is disabled.

Additional modifications and variations of the present invention are possible in light of the above teachings. It is therefore to be understood that, within the scope of the appended claims, the invention may be practiced other than as specifically described herein.

What is claimed is:

1. A liquid coating device comprising:

a container to store a liquid;

a liquid reservoir having a greater air-tightness than that of the container;

a liquid coating applicator to apply the liquid stored in the container to a target object;

a conveyer to convey the target object;

a liquid conveyer to convey the liquid stored in the container to the liquid reservoir; and a controller to control operation of the liquid coating device and convey the liquid stored in the container to the liquid reservoir when the target object is conveyed without application of the liquid coating in the applicator.

2. The liquid coating device as claimed in claim 1, wherein the controller disables operation of the liquid coating applicator for a malfunction of the liquid coating applicator when the liquid coating applicator is not applying liquid and the conveyer conveys the target object.

3. The liquid coating device as claimed in claim 1, wherein the controller discontinues supply of liquid to the container of the liquid coating applicator when the liquid coating applicator is not applying liquid and the conveyer conveys the target object.

4. An image forming system comprising:

an image forming device to form an image by discharging color material onto a target object; and a liquid coating device to apply a liquid to the target object before outputting the formed image, including:

a container to store the liquid;

a liquid reservoir having a greater air-tightness than that of the container;

a liquid coating applicator to apply the liquid stored in the container to the target object;

a conveyer to convey the target object;

a liquid conveyer to convey the liquid stored in the container to the liquid reservoir; and a controller to control operation of the liquid coating device and convey the liquid stored in the container to the liquid reservoir when the target object is conveyed without application of the liquid coating in the applicator.

5. A method of controlling the liquid coating device of claim 1, comprising:

applying a liquid stored in a container to a target object with a liquid coating applicator;

conveying the liquid stored in the container to a liquid reservoir having a higher air-tightness than that of the container with a liquid conveyer; and conveying the liquid stored in the container to the liquid reservoir when the target object is conveyed without application of the liquid coating in the applicator.

* * * * *